US005992631A

United States Patent [19]

Eeckhout et al.

[11] Patent Number: 5,992,631

[45] Date of Patent: Nov. 30, 1999

[54] ASSEMBLY OF SELF-STANDING POUCHES

[75] Inventors: Jan Eeckhout, Denderleeuw; Andrew John Fagg, Brussels, both of Belgium

[73] Assignee: The Procter & Gamble Company, Cincinnati, Ohio

[21] Appl. No.: 09/155,381

[22] PCT Filed: Mar. 18, 1997

[86] PCT No.: PCT/US97/03700

§ 371 Date: Sep. 28, 1998

§ 102(e) Date: Sep. 28, 1998

[87] PCT Pub. No.: WO97/35785

PCT Pub. Date: Oct. 2, 1997

[30] Foreign Application Priority Data

Mar. 28, 1996 [EP] European Pat. Off. ..... 962 00 846
Oct. 2, 1996 [EP] European Pat. Off. ..... 962 02 744

[51] Int. Cl.[6] ..... B65D 77/04

[52] U.S. Cl. ..... 206/499; 206/524.1

[58] Field of Search ..... 206/216, 223, 206/499, 524.1, 77.1, 83.5

[56] References Cited

U.S. PATENT DOCUMENTS 4,555,017 11/1985 Blackmore ..... 206/83.5
4,793,490 12/1988 Evert ..... 206/499 X

*Primary Examiner*—Jacob K. Ackun
*Attorney, Agent, or Firm*—James C. Vago; T. David Reed

[57] ABSTRACT

The present invention provides a shipping unit comprising more than one flexible pouch (15) and a secondary package (20). Each flexible pouch is filled with a granular laundry detergent. The secondary package contains the filled pouches of the shipping unit and keeps the filled pouches together in the shipping unit. The secondary package is in a closed position such to prevent the exit of any of the filled pouches prior to opening of the shipping unit. The secondary package is flexible and non-resistant to compression force when the shipping unit is stacked with other shipping units in an assembly, and the granular laundry detergent contained in each flexible pouch has a cake strength of less than or equal to 200 g/cm$^2$. This shipping unit is able to carry the load of other stacked shipping units to form an assembly in form of a pallet.

10 Claims, 2 Drawing Sheets

ASSEMBLY OF SELF-STANDING POUCHES

FIELD OF THE INVENTION

The present invention relates to an assembly of self-standing flexible pouches whereby the pouches contain granular or powdered products.

BACKGROUND OF THE INVENTION

A great variety of packages have been described which are suitable for packaging granular or liquid detergent. A constant preoccupation of detergent manufacturers is to provide packaged goods which are convenient to handle and in particular to store. This requirement includes the possibility to stack packages so that minimum ground space is required.

Granular laundry detergents are known to be packed into flexible pouches. The flexible pouches are such that they are not able to carry any load in an assembly when single or grouped flexible pouches are stacked one over another in the assembly during storing and transportation of the flexible pouches. The load of the stacked assembly is immediately transferred to the contained detergent. It has now been found that certain type of packaged granular or powdered detergents are not able to carry the load and sustain the weight of other packaged granular or powdered detergent when the packaged detegents are stacked in an assembly. Indeed, it is known that certain types of granular detergent "cakes". To "cake" means in the following that the granular or powdered detergent sticks or aggregates together forming lumps when put under a compression force, like a top load. The caking may be such that the detergent aggregates into one insoluble block. The "caking" of a detergent may adversely affect the washing properties of the detergent itself.

The so called "cake strength" is a measure of the caking of a granular or powdered detergent. The "cake strength" is defined to be the force needed to disaggregate a caked detergent. This means that a lower cake strength results in less caking of the detergent. For example, a cake strength of 0 g/cm$^2$ means that the detergent does not cake. The cake strength of a granular or powdered detergent varies with the composition or manufacturing method of the detergent itself. Therefore, especially when the pouches are filled with granular or powdered detergent susceptible to caking, it is important to take care that the weight or load from the stacked assembly is not carried by the detergent.

To avoid caking of the granular or powdered detergent, the filled flexible pouches are usually combined into a shipping unit which is formed by a high strength outer case. This outer case is able to support the stacking of several shipping units in an assembly. This also means that only the outer case and not the filled pouches combined into these outer cases carry the weight or support the compression force from the stacked assembly. This is certainly one way to avoid caking of the granular or powdered detergent. However, the manufacturing cost of such a packaging assembly is relatively high. Furthermore, the use of the above mentioned outer cases increases the waste packaging materials. Indeed, the outer cases are usually not reusable after the storing and transportation of the flexible pouches. Therefore, the manufacturers of detergent compositions are in need to reduce the costs of the packaging and to reduce the waste packaging materials necessary for handling, storing and transportation of detergent filled in flexible pouches.

It is therefore an object of the present invention to provide a shipping unit of flexible pouches, the flexible pouches being filled with granular or powdered detergent less susceptible to caking when stacking other flexible pouches one over another, and without the need to combine these filled, flexible pouches into outer cases which carry the compression force from the stacked assembly.

SUMMARY OF THE INVENTION

The present invention is a shipping unit comprising more than one flexible pouch and a secondary package. Each flexible pouch is filled with a granular laundry detergent. The secondary package contains the filled pouches of the shipping unit and keeps the filled pouches together in the shipping unit. The secondary package is closed so that it prevents the exit of any of the filled pouches prior to opening of the shipping unit. The secondary package is flexible and non-resistant to compression force when the shipping unit is stacked with other shipping units in an assembly, and the granular laundry detergent contained in each flexible pouch has a cake strength of less than or equal to 200 g/cm$^2$.

The present invention further provides an assembly of shipping units forming a pallet unit.

DETAILED DESCRIPTION OF THE INVENTION

Figure 1:
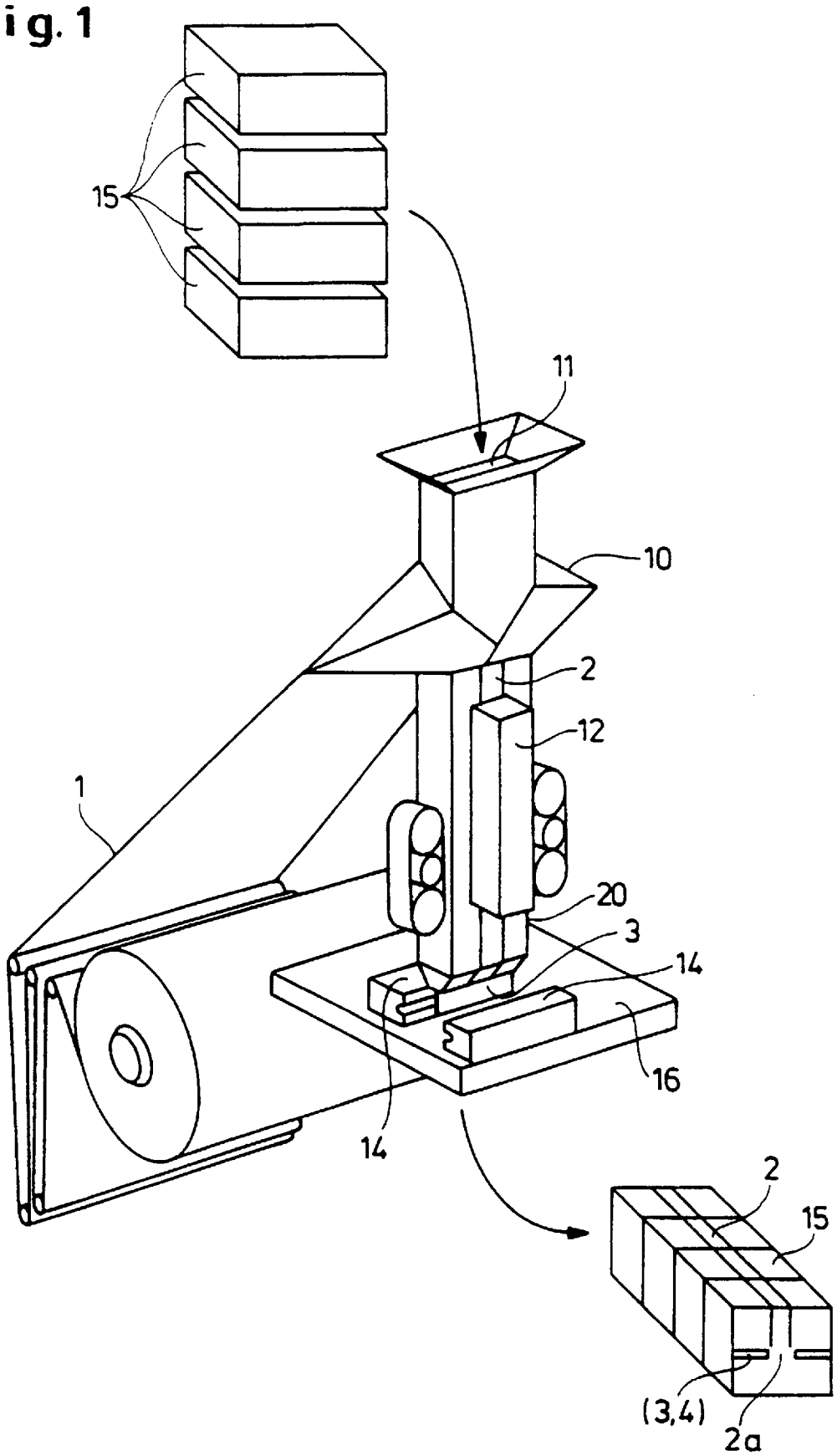
FIG. 1 is a perspective view of part of the packaging machine showing the method to assemble filled packages together into a secondary package according to the present invention.

As hereinafter understood, a pouch or a secondary package being "flexible and non-resistant to compression force" means that the pouch or the secondary package is such that it is not able to carry any load in an assembly when single pouches or pouches grouped in a secondary package are stacked one over another in the assembly during storing and transportation of the pouches. The load of the stacked assembly is immediately transferred to the content of the pouches.

The pouch according to the present invention is flexible and non-resistant to compression force. The flexible pouch is preferably made of a material selected from the group consisting of: tissue, metal foil, paper, plastic materials and a combination thereof. As plastic materials polyolefines, like polyethylene (=PE), or (oriented) polyethylene terephthalate, or (oriented) polypropylene or a combination thereof, may be used. When the flexible pouch is made of a multi-layer material, the intermediate layers may comprise a perfume barrier layer, a gas barrier layer, an oxygen barrier layer, a moisture barrier layer, or a combination thereof. Preferably, the intermediate layer is made of a material selected from the following group consisting of: aluminium foil, ethyl vinyl alcohol co-polymer (=EVOH), lacquer coating and a combination thereof. Possible lacquer coatings are, for example, Flexplastol® 2KB-Lacquer 9A 918 920 or Flexoplastol® 2KB-Lacquer 9A 919 920 commercially available from BASF Lacke+Farben AG, Stuttgart.

The flexible pouch comprising multi-layers may be achieved by laminating or extruding the layers together. The lamination of layers means that the different layers are attached to each other in a solid state, i.e. the different layer are not melted together as in the extrusion process. In the lamination process lower temperatures are used with respect to the extrusion. As a preferred option, a tie layer may be used at least on one side of the intermediate layers to strengthen the bonding between the intermediate layers and the other layers. Said tie layer is preferably made of glue. A preferred glue is a polyurethane-based adhesive. By polyurethane-based adhesives it is intended all the adhesives based on polyurethane known to the person skilled in the art. In particular, solvent based (including water) and solvent-free adhesive systems comprising polyurethane are usable for the purpose of the present invention. This tie layer can be also applied on both sides of said intermediate layer and/or of the other layers.

Preferably, the flexible pouch according to the present invention is a stand-up or self-standing pouch. This flexible, stand-up pouch may be formed in different possible ways. One possibility is a gusseted pouch. This type of pouches is described, for example, in EP-A-620 156, DE-A-2 520 084, DE-A-3 926 728 and U.S. Pat. No. 3,659,775 which are herewith incorporated for further reference. These documents further describe the forming and filling process of these pouches. Another possibility is a pouch having a broadened bottom base as described for example in EP-A-0 626 319 and/or EP-A-0 681 970 which are also herewith incorporated for further reference. The same documents describe also the corresponding forming and filling process of these pouches.

Preferably, the stand-up pouch according to the present invention has an air-free portion. This means that the pouches are not completely filled with the granular or powdered detergent and the remaining part of the volume of the pouch is under a partial or substantially complete vacuum. This vacuum is maintained starting from an unfilled, flat pouch during the filling and sealing operation. The air-free portion is preferably folded to create a nearly flat surface. This nearly flat surface is sufficiently great to support the base of another stacked pouch. The air-free portion folded to a nearly flat surface is preferably fastened with adequate means. This fastening means may be, for example, selected from the group consisting of: ligatures, adhesive tapes, straps, plastic film bands, shrinkable plastic film bands and any combination thereof. These fastening means are placed partially or completely around the pouch maintaining the air-free portion in a folded, nearly flat surface, therefore preventing this nearly flat surface to unfold. The folding of the air-free free portion and the fastening means are further described and illustrated in EP-A-0 681 970 which is herewith incorporated for further reference.

The stand-up, flexible pouches according to the present invention are filled with granular or powdered detergent having a cake strength of less than or equal to 200 9/cm$^2$. Specifically, the cake strength of granular or powdered detergent having a density of up to 600 g/l is no more than 200 g/cm$^2$. The cake strength of granular or powdered detergent having a density of greater than 600 g/l is preferably up to 100 g/cm$^2$, more preferably less than 90 g/cm$^2$, even more preferably less than 80 g/cm$^2$, even more preferably less than 60 g/cm$^2$, most preferably less than 50 g/cm$^2$. As said before, the cake strength is the strength needed to disaggregate a caked detergent. The cake strength of a granular or a powdered detergent is measured and determined in the following manner.

Figure 2:
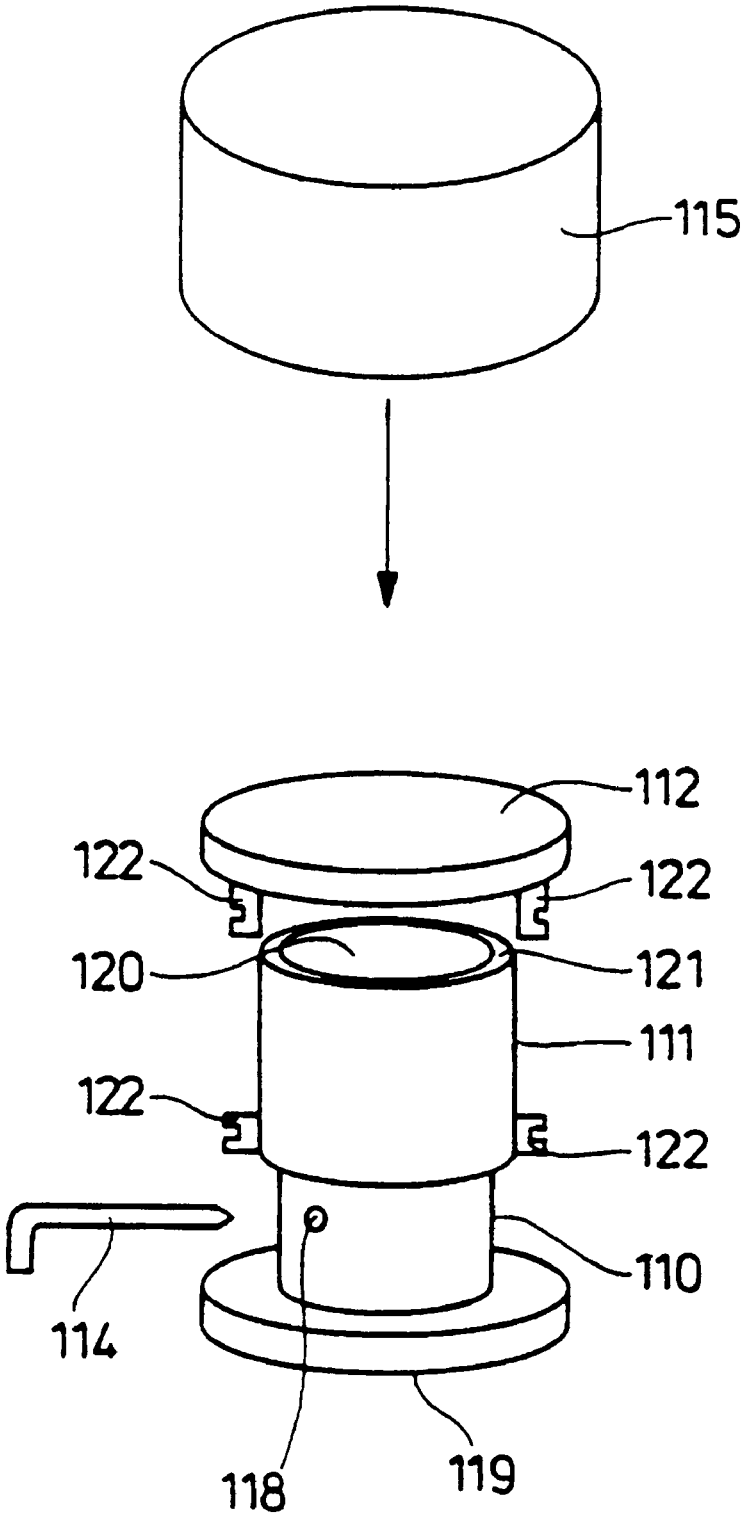
FIG. 2 illustrates the method to measure the cake strength of a granular or powdered detergent.

The apparatus for measuring the cake strength is shown in FIG. 2 and comprises a cylinder (110), a sleeve (111), a lid (112), a locking pin (114), a weight (115) and a force gauge (not shown). The cylinder further comprises a hole (118) in which the locking pin can be inserted. The cylinder stands on its closed base (119), whereby the cylinder is filled with detergent through the opposed open top end (120). Firstly, the locking pin (114) is inserted into the hole (118) and then the sleeve (111) is slid over the outermost surface of the cylinder until the sleeve rests on the locking pin. Thereby, the top end (121) of the sleeve remains higher than the top end (120) of the cylinder. The open volume between the top end of the cylinder and the top end of the sleeve has following dimensions: diameter 6.35 cm and height 3 cm. This volume is filled with a detergent up to the top end of the sleeve and levelled off with the top end of the sleeve.

The lid (112) is now placed on top of the sleeve (111). Preferably, the lid is made of a very light material, but resistant enough to carry a load and able to compress the detergent. A preferred material is Perspex® (from ICI). The weight (115) is now placed on top of the lid. The total weight of the lid (112) together with the weight (115) is 5 kg. The lid is further fastened to the sleeve to avoid that the lid moves. The fastening of the lid to sleeve is achieved according to the present method stretching an elastic band around appropriate lugs (122) on the lid and the cylinder. Once the weight is placed on top of the lid, the locking pin (114) is removed from the hole (118). In this manner, the weight compresses together the detergent located between the lid (112) and the top end (120) of the cylinder. The weight is left according to the measurement standard of the present invention for two minutes. Thereafter, the weight is removed from the top of the lid. All the elastic bands are also removed.

The sleeve (111) is now gently slid down towards the closed end (119). Consequently, the detergent located between the lid (112) and the top end (120) of the cylinder is not confined anymore by any lateral walls. In principle, this detergent is free to flow away from this region. However, the free flow of the detergent located in this region depends from the caking of this detergent experienced during the compression of the weight (115). Indeed, a partial caking of the detergent in this region may impede a free flow of the detergent. It has been found that by applying a force on the detergent located in this region, the possibly caked detergent disaggregates such that the detergent may be free to flow away again. The force needed to observe this free flow of the detergent from this region is the cake strength according to the present method of measurement. The cake strength is measured by a force gauge which is applied onto the centre of the lid (112). Pressing increasingly the force gauge onto the lid, an increasing amount of force is applied onto the detergent. The force at which the detergent collapses and freely flows away from the region between the lid and the open end of the cylinder is considered to be the cake strength of the detergent. These measurements of the cake strength are made at about 20° C. and within about 45% and 70% of relative humidity.

The Detergent Composition

By the term detergent composition herein is meant laundry detergent compositions, as well as automatic dishwashing compositions and laundry additive compositions.

The present compositions are characterized by their cake strength of less than 100 g/cm$^2$.

Anionic Surfactants

In the preferred embodiment herein, where the detergent compositions herein is a laundry detergent composition, compositions of the present invention usually contain one or more anionic surfactants as described below.

Alkyl Sulfate Surfactant

Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10-20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12-20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}$E(1.0)M), $C_{12}$–$C_{18}$ alkyl polyethoxylate (2.25) sulfate, $C_{12}$–$C_{18}$E(2.25)M), $C_{12}$–$C_{18}$ alkyl polyethoxylate (3.0) sulfate $C_{12}$–$C_{18}$E(3.0), and $C_{12}$–$C_{18}$ alkyl polyethoxylate (4.0) sulfate $C_{12}$–$C_{18}$E(4.0)M), wherein M is conveniently selected from sodium and potassium.

Other Anionic Surfactants

Other anionic surfactants useful for detersive purposes can also be included in the laundry detergent compositions of the present invention with or without the species described above. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ehtylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_4$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred surfactants for use in the compositions herein are the alkyl sulfates,alkyl alkoxylated sulfates, and mixtures thereof.

When included therein, the laundry detergent compositions of the present invention typically comprise from about 1% to about 40%, preferably from about 3% to about 20% by weight of such anionic surfactants.

Nonionic Surfactants

The present laundry detergent compositions preferably also comprise a nonionic surfactant.

While any nonionic surfactant may be normally employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of aikylene oxide groups (hydrophilic in nature) with an organic hydrophobic compound, which may be aliphatic oralkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 to 7 moles of ethylene oxide per mole of alcohol, preferably 3 to 5.

The nonionic surfactant system herein can also include a polyhydroxy fatty acid amide component.

Polyhydroxy fatty acid amides may be produced by reacting a fatty acid ester and an N-alkyl polyhydroxy amine. The preferred amine for use in the present invention is N-(R1)-CH2(CH2OH)4-CH2-OH and the preferred ester is a C12–C20 fatty acid methyl ester. Most preferred is the reaction product of N-methyl glucamine with C12–C20 fatty acid methyl ester.

Methods of manufacturing polyhydroxy fatty acid amides have been described in WO 92 6073, published on Apr. 16, 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This directly yields nonionic surfactant systems which are preferred in the present invention, such as those comprising N-methyl glucamide and C12–C14 alcohols with an average of 3 ethoxylate groups per molecule.

Nonionic surfactant systems, and granular detergents made from such systems have been described in WO 92 6160, published on Apr. 16, 1992. This application describes (example 15) a granular detergent composition prepared by fine dispersion mixing in an Eirich RV02 mixer which comprises N-methyl glucamide (10%), nonionic surfactant (10%).

Both of these patent applications describe nonionic surfactant systems together with suitable manufacturing processes for their synthesis, which have been found to be suitable for use in the present invention.

The polyhydroxy fatty acid amide may be present in compositions of the present invention at a level of from 0% to 50% by weight of the detergent component or composition, preferably from 5% to 40% by weight, even more preferably from 10% to 30% by weight.

Also useful as the nonionic surfactant of the surfactant systems of the present invention are thealkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Other Surfactants

The laundry detergent compositions of the present invention may also contain cationic, ampholytic, zwitterionic, and semi-polar surfactants, as well as nonionic surfactants other than those already described herein, including the semi-polar nonionic amine oxides described below.

Cationic detersive surfactants suitable for use in the laundry detergent compositions of the present invention are those having one long-chain hydrocarbyl group. Examples of such cationic surfactants include the ammonium surfactants such as alkyldi- or tri-methylammonium compounds, and those surfactants having the formula:

$$[R^2(OR^3)y][R^4(OR^3)y]_2R^5N+X-$$

wherein R2 is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2COH—CHOHCOR^6CHOHCH_2OH$ wherein R6 is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

When included therein, the laundry detergent compositions of the present invention typically comprise from 0% to about 25%, preferably form about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quarternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting af alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

$$O$$
$$R^3(OR^4)xN(R^5)2$$

Builder

The laundry detergent compositions and automatic dishwashing compositions herein contain a builder, preferably non-phosphate detergent builders, although phosphate-containing species are not excluded in the content of the present invention. These can include, but are not restricted to alkali metal carbonates, bicarbonates, silicates, aluminosilicates, carboxylates and mixtures of any of the foregoing. The builder system is present in an amount of from 1% to 80% by weight of the composition, typically preferable from 20% to 60% by weight in granular laundry detergent compositions herein, and from 1% to 30% in liquid laundry detergent compositions herein.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being preferred.

Within the silicate class, highly preferred materials are crystalline layered sodium silicates of general formula $$NaMSi_xO_{2x}+1.yH2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2,3 or 4 and is preferably 2. More preferably M is sodium and y is 0 and a preferred example of this formula comprise the form of $Na_2Si_2O_5$. These materials are available from Hoechst AG FRG as respectively NaSKS-5, NaSKS-7, NaSKS-11 and NaSKS-6. The most preferred material is $Na_2Si_2O_5$, NaSKS-6. Crystalline layered silicates are incorporated either as dry mixed solids, or as solid components of agglomerates with other components.

Whilst a range of aluminosilicate ion exchange materials can be used, preferred sodium aluminosilicate zeolites have the unit cell formula $$Na_z[(AIO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAIO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 0.01 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope.

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite X, P and MAP, the latter species being described in EPA 384 070. In an especially preferred embodiment, the crystalline aluminosilicate ion exchange material is a Zeolite A having the formula $$Na_{12}[(AIO_2)_{12}(SiO2)_{12}].xH_2O$$

wherein x is from about 20 to about 30, especially about 27 and has a particle size generally less than about 5 microns.

Suitable carboxylate builders containing one carboxy group include lactic acid, glycollic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegungschrift 2,446,686 and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829,1, and the 1,2,2-ethane tetracarboxylates ,1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran -cis-dicarboxylates, 2,2,5,5,-tetrahydrofuran-tetracarboxylates, 1,2,3,4,5,6-hexane hexacarboxylates and carbxoymethyl derivatives of polyhydric alcohols such as sorbitol, mannitol and xyiitol. Aromatic polycarboxylates include mellitic acid, pyromellitic acid and the phtalic acid derivates disclosed in British Patent No. 1,425,343.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorous are permitted in detergent compositions, and include ethylenediaminetetrakis (methylenephosphonates) as DEQUEST. Preferred, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethyelediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Of the above, the preferred polycarboxylates are hydroxycarboxylates containing up to three carboxy groups per molecule, more particularly citrates.

The granular detergent compositions and automatic dishwashing compositions herein have a pH above 8.5, preferably in the range of from 9 to 11.

The present laundry granular compositions are preferably in a compact form, having a bulk density of at least 650 g/l, preferably at least 750 g/l, but can also be in a conventional form, with densities in a range of from 200 g/l to 700 g/l.

In another embodiment of the invention, are provided

Automatic Dishwashing Compositions:

Automatic dishwashing compositions typically contain, in addition to percarbonate a builder, such as described above, a source of alkalinity, such as silicate or carbonate, those ingredients amounting to up to 70% of the formulation. Optional ingredients include polymers and enzymes.

In still another embodiment of the invention, are provided

Laundry Additive Compositions:

Such compositions typically contain the bleaching agent at levels of from 15 to 80% by weight.

Optional Ingredients

Other ingredients which are known for use in detergent compositions may also be used as optional ingredients in the various embodiments of the present invention, such as bleach activators, bleach catalysts, other bleaching agents, polymers, enzymes, suds suppressing agents, fabric softening agents, in particular fabric softening clay, as well as dyes, fillers, optical brighteners, pH adjusting agents, non builder alkalinity sources, enzyme stability agents, hydrotopes, solvents, perfumes.

The Percarbonate Particles

The compositions herein contain from 1% to 40%, preferably from 3% to 30% by weight, most preferably from 5% to 25% by weight of an alkali metal percarbonate bleach; in the form of particles having a mean size from 250 to 900 micrometers, preferably 500 to 700 micrometers.

When the compositions herein are laundry additives, the level of percarbonate is from 20% to 80% by weight.

The alkali metal percarbonate bleach is usually in the form of the sodium salt. Sodium percarbonate is an addition compound having a formula corresponding to $2Na_2CO_3$ $3H_2O_2$. to enhance storage stability the percarbonate bleach can be coated with a further mixed salt of an alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:2000 to 1:4, more preferably from 1:99 to 1:9, and most preferably from 1:49 to 1:19. Preferably, the mixed salt is of sodium sulphate and sodium carbonate which as the general formula Na2SO4.n.Na2CO3 wherein n is from 0.1 to 3, preferably n is from 0.3 to 1.0 and most preferably n is from 0.2 to 0.5.

Other suitable coating materials are sodium silicate, of SiO2:Na2O ratio from 1.6:1 to 2.8:1, and magnesium silicate.

Commercially available carbonate/sulphate coated percarbonate bleach may include a low level of a heavy metal sequestrant such as EDTA, 1-hydroxyethylidene 1,1-diphosphonic acid (HEDP) or an aminophosphonate, that is incorporated during the manufacturing process.

Bleach activators

The present compositions, especially the granular laundry detergent compositions and laundry additives described above, preferably contain from 1% to 20% by weight of the composition, preferably from 2% to 15% by weight, most preferably from 3% to 10% by weight of a peroxyacid bleach activator, in addition to the percarbonate bleaching agent described above.

Peroxyacid bleach activators (bleach precursors) as additional bleaching components in accordance with the invention can be selected from a wide range of class and are preferably those containing one or more N-or O-acyl groups.

Suitable classes include anhydrides, esters, amides, and acylated derivatives of imidazoles and oximes, and examples of useful materials within these classes are disclosed in GB-A-1586789. The most preferred classes are esters such as are disclosed in GB-A-836 988, 864,798, 1 147 871 and 2 143 231 and amides such as are disclosed in GB-A-855 735 and 1 246 338.

Particularly preferred bleach activator compounds as additional bleaching components in accordance with the invention are the N-,N,N'N' tetra acetylated compounds of the formula

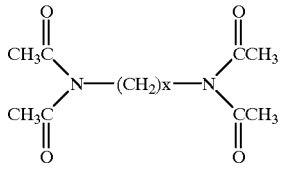

where x can be O or an integer between 1 and 6.

Examples include tetra acetyl methylene diamine (TAMD) in which x=1, tetra acetyl ethylene diamine (TAED) in which x=2 and Tetraacetyl hexylene diamine (TAHD) in which x=6. These and analogous compounds are described in GB-A-907 356. The most preferred peroxyacid bleach activator as an additional bleaching component is TAED.

Another preferred class of peroxyacid bleach compounds are the amide substituted compounds of the following general formulae:

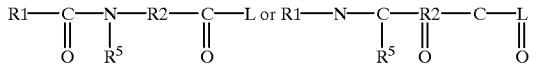

wherein $R^1$ is an aryl or alkaryl group with from about 1 to about 14 carbon atoms, $R^2$ is an alkylene, arylene, and alkarylene group containing from about 1 to about 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

Another class of bleach activators to use in combination with percarbonate comprises $C_8$, $C_9$, and/or $C_{10}$ (6-octanamidocaproyl) oxybenzenesulfonate, 2-phenyl-(4H)3,1 benzoxazin-4-one, benzoyllactam preferably benzoylcaprolactam and nonanoyl lactam preferably nonanoyl caprolactam.

Bleaching agents

The granular laundry detergent, automatic dishwashing compositions or laundry additives herein may contain an additional bleaching agent, in addition to the percarbonate.

The additional bleaching agent, if used, is either an inorganic persalt such as perborate, persulfate, or a preformed organic peracid or perimidic acid, such as N,N phtaloylaminoperoxy caproic acid, 2-carboxyphtaloylaminoperoxy caproic acid, N,N phtaloylaminoperoxy valeric acid, Nonyl amide of peroxy adipic acid, 1,12 diperoxydodecanedoic acid, Peroxybenzoic acid and ring substituted peroxybenzoic acid, Monoperoxyphtalic acid (magnesium salt, hexhydrate), Diperoxybrassylic acid.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000. Also useful are terpolymers of maleic/acrylic acid and vinyl alcohol having a molecular weight ranging from 3.000 to 70.000.

Polymeric polycarboxylate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Polyaspartate and polyglutamate dispersing agents may be used, especially with zeolite builders. Dispersing agents such as polyasparatate preferably have a molecular weight of about 10,000.

Other useful polymers include species known as soil release polymers, such as described in EPA 185 427 and EPA 311 342.

Still other polymers suitable for use herein include dye transfer inhibition polymers such as polyvinylpyrrolidone, polyvinylpyrridine, N-oxide, N-vinylpyrrolidone, N-imidazole, polyvinyloxozolidone or polyvinylimidazole.

Enzymes

Enzymatic materials can be incorporated into the detergent compositions herein. Suitable are proteases, lipases, cellulases, peroxidases, amylases and mixtures thereof.

A suitable lipase enzyme is manufactured and sold by Novo Industries A/S (Denmark) under the trade name Lipolase and mentioned along with other suitable lipases in EP-A-0258068 (Novo Nordisk).

Suitable cellulases are described in e.g. WO-91117243 and WO 91/17244 (Novo Nordisk).

Preferred commercially available protease enzymes include those sold under the trade names Alcalase and Savinase by Novo Industries A/S (Denmark) and Maxatase by International Bio-Synthetics, Inc. (The Netherlands).

Other proteases include Protease A (see European Patent Application 130 756, published Jan. 9, 1985) and Protease B (see European Patent Application Serial No. 87303761.8, filed Apr. 28, 1987, and European Patent Application 130 756, Bott et al, published Jan. 9, 1985).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo- peroxidase. Peroxidase-containing detergent compositions are disclosed, for example, in PCT International Application WO 89/099813 and in WO 91/05839.

Amylases include, for example, -bacterial amylases obtained from a special strain of B. licheniforms, described in more detail in GB-1,296,839 (Novo). Preferred commercially available amylases include for example, Rapidase, sold by International Bio-Synthetics Inc. and Termamyl, sold by Novo Nordisk A/S. Fungal amylases such as Fungamyl® amylase, sold by Novo Nordisk, can also be used. Preferred process for making the laundry detergent composition herein.

In a preferred process for making the laundry detergent compositions of the present invention, in particular when a high bulk density is desired, part or all of the surfactant contained in the finished composition is incorporated in the form of separate particles; said particles may take the form of flakes, prills, marumes, noodles, ribbons, but preferably take the form of granules. The most preferred way to process the particles is by agglomerating powders (such as e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebrueder Lodige Maschinenbau GmbH, D-4790 Paderborn 1, Elsenerstrasse 7–9, Postfach 2050, Germany. Most preferably a high shear mixer is used, such as a Lodige CB (Trade Name).

A high active surfactant paste comprising from 50% by weight to 95% by weight, preferably 70% by weight to 85% by weight of surfactant is used. The surfactant system may comprise any of the groups of anionic, nonionic, cationic, amphoteric, and zwitterionic surfactants, or mixtures of these. The paste may be pumped into the agglomerator at a temperature high enough to maintain a pumpable viscosity, but low enough to avoid degradation of the anionic surfactants used. An operating temperature of the paste of 50° C. to 80° C. is typical.

A particularly suitable process of making surfactant particles from high active surfactant pastes is more fully described in EP 510 746, published on Oct. 28, 1992.

The free-flowing surfactant particles made by the process described above are then mixed with other detergent components, such as the particles containing the alkalimetal percarbonate in order to produce a finished detergent composition.

This mixing may take place in any suitable piece of equipment. Liquid detergents such as nonionic surfactant and perfume may be sprayed on to the surface of one or more of the constituent granules, or onto the finished composition.

Shipping Unit

Several of these flexible pouches are preferably grouped together in a shipping unit. Preferably, the shipping unit is formed to a rectangular shape. In this manner, the shipping unit is suitable to be stacked with other similar shipping units for storage and transport. A complete assembly or pallet stack is obtained by stacking several of these shipping units. Preferably, the shipping unit may be formed by packing several flexible pouches in a secondary package. The primary package is hereinafter understood to be the flexible pouch itself containing the detergent.

The secondary package according to the present invention is flexible and non-resistant to compression. The secondary package may be preferably made of a wrap-around film. Preferably, the wrap-around film may be made of polyethylene or paper based films. A paper based film is preferably a film made out of a layer of a plastic film laminated to a layer of paper. More preferably, the polyethylene films have a thickness in the range of about 20 $\mu$m to 200 $\mu$m, more preferably in the range of about 50 $\mu$m to 100 $\mu$m. The paper based films have preferably a weight in the range of about 50 g/m$^2$ to 200 g/m$^2$. For example, a paper based film is made of a layer of polyethylene having a thickness of 50 $\mu$m and a layer made of paper having a weight of 80 g/m$^2$.

Preferably, the packaging process of the pouches filled with detergent into the secondary package is achieved with a conventional vertical packing machine, so called Vertical Form Fill Seal (=VFFS). A partial perspective view of such a vertical packing machine is shown in FIG. 1. These vertical packaging machines include inter alia at least a forming shoulder (10). The method for making the secondary package with the VFFS is a continuous batch-process. The film (1) is fed into the VFFS machine in a flat configuration. This film is carried to the forming shoulder (10) which is also the filling head (11). The film is pulled around the forming shoulder (10) which extends in a vertical tube.

By pulling the plastic film around the forming shoulder, the plastic film is formed into a tubular configuration with overlapping vertical edges (2). "Vertical" in the sense that these edges are parallel to the filling direction of the VFFS machine. To maintain the tubular configuration of the plastic film, the overlapping vertical edges (2) of the film are completely or partially sealed together. Preferably, the vertical edges are only partially sealed together, i.e. the seal is interrupted at least in one region along the vertical edges (2). The interruption in the seal gives a free access to the interior of the secondary package. The dimension of this interrupted seal is such to enable a user to insert at least a finger into the interrupted region, but not great enough to allow the exit of filled primary packages (15). Preferably, the dimension of the interrupted region is such to enable the insertion of a hand. By allowing the user to insert at least a finger or a hand into the interrupted region facilitates the opening of the secondary package by tearing the partial seal along the vertical edges (2). Preferably, more than one interrupted region is achieved with the partial seal along the vertical edges (2). For example, if the vertical edge (2) is 80 cm long, a 2 cm long seal is interrupted for 11 cm before the next 2 cm seal. This is repeated along the vertical edge up to 80 cm. The same can be made to a vertical edge (2) being 50 cm long.

The film in tubular form is further sealed on the opposite end to the filling head so as to form a bottom seal (3) with the cross seal located within the outer clamps (14). The bag formed in this way is a secondary package (20) according to the present invention having an open end towards the filling head of the forming shoulder. This secondary package can now be filled with several filled primary packages through the filling head and the open end.

The filled primary packages (15) are dropped through the filling head (11) into the secondary package (20) through the open end of the secondary package. The filled primary packages pile up from the bottom seal (3) of the secondary package. Preferably, the filled primary packages are dropped into the secondary package in such a manner that the filled primary packages do not turn in the secondary package during falling within this secondary pouch. This is especially important when the shape of the filled primary packages allows a minimum packing space in a specific direction, and not in a different direction which may oblige the secondary package to need an increased packing space. Indeed, for rectangular filled primary packages, for example, the length of the secondary package can be reduced by lining the filled primary packages along the width and not the length or the height of the primary packages . This is achieved preferably by tailoring the dimension of the secondary package with the dimensions of the filled primary packages. As an example, the secondary package has a rectangular shape and the following dimensions: length about 38 cm, width about 14.5 cm and height about 14.5 cm. Consequently, four flexible pouches having the dimensions of about 9.2 cm length, 14.5 cm width and 14.0 cm height can be packed into this secondary package described before.

Preferably, the filled primary packages which should enter into one secondary package are first collated together. The collating of the filled primary packages together is achieved also without using any fastening means, such as tape-wrapping for example. Therefore, the filled primary packages collated together are dropped as a whole collated bundle into the secondary package. It has been found that this collating of the filled primary packages further ensures that the filled pouches do not turn upside down or in any other direction during the falling into the secondary package.

Preferably, outer clamps (14) of the VFFS hold the secondary package around the bottom seal during the filling of the secondary package. The outer clamps are usually used to clamp the film while sealing and/or cutting the film. Indeed, the film is usually fixed between the two halves of outer clamps before the sealing and/or cutting. In this case the film around the bottom seal is first fixed between the two halves of the outer clamp during the filling with the filled primary packages to support the landing of the filled primary packages in the secondary package. This is to avoid that the film of the secondary package is stretched up to rupture during the landing and piling up of the filled primary packages. It has been found that the total weight which can be dropped in this manner through the filling head into the secondary package without any danger for the outer clamps is up to 25 kg. However, the VFFS may be provided with an additional supporting means to support the landing of the filled primary packages which may carry a higher load.

Preferably, once the secondary package is filled with several filled primary packages and the bottom seal (3) is sufficiently cooled down, the outer clamps (14) are opened and the secondary package with the filled primary packages is advanced up to a holding means (16). The holding means preferably holds the secondary package filled with the primary packages during the advance of the secondary package until all filled primary packages contained in the secondary package are under the cross seal. This holding system is preferably located below the outer clamps (14) and is made of a plane movable preferably in a direction parallel to the filling of the secondary package with the primary packages. The filled secondary package being held by the holding means reduces the tension on the film of the secondary package which reduces the possibility of rupture of this film. The holding means further help to adjust the height of the top seal on the secondary package with respect to the height of the filled primary packages inside the secondary package. Consequently, the holding means ensures that the top seal tightly closes the top end of the secondary package around the filled pouches. Preferably, the holding system is further able to raise up the secondary package filled with the primary packages towards the cross seal to correct the position of the top seal on the secondary package.

Consequently, the filled primary packages inside the secondary package are preferably wrapped in a substantially tight manner such that the primary packages have less space to turn around or upside down inside the secondary package. This means that the secondary package filled with the filled primary packages forms preferably a compact bundle. Nevertheless, the secondary package itself does not exert any tension force on the contained filled packages. Therefore, the secondary package prevents that the filled primary packages, especially when they are filled flexible pouches, are deformed by the secondary package. Indeed, rectangular flexible filled pouches may be deformed into a round shape when the filled pouches are bundled together in a stretch film wrapping, for example. The round shape of the filled flexible pouches is disadvantageous when stacking bundles of filled flexible pouches one over another, since the stability of the stacking is lower with respect to stacked rectangular pouches.

As another preferred option, before sealing the top end opposed to the bottom seal of the secondary package, the outer clamps are preferably substantially closed again and the film advance system of the film in the VFFS is reversed. In this manner the secondary package is pulled up again until the filled primary packages are at least partially pressed against the outer clamps. Indeed, the outer clamps are substantially closed such that the filled primary packages cannot pass through the outer clamps. Preferably, the outer clamps are closed more than 50%, more preferably at about 80%. This reduces the length of the film used for a secondary package. Consequently, the filled primary packages inside the secondary package are preferably wrapped in a substantially tight manner such that the primary packages have less space to turn around or upside down inside the secondary package. This means that the secondary package filled with the filled primary packages preferably forms a compact bundle. It has been found that the wrapping of the filled primary package with the secondary package is further improved, if this reversing of the film advance system in the VFFS is combined with the holding system, as described before. Furthermore, the filled secondary package being held by the holding means reduces the tension on the film of the secondary package which reduces the possibility of rupture of this film.

To make a top seal (4) the outer clamps are fully closed. Once the clamps are fully closed, a top seal (4) is made opposite to the bottom seal closing completely the secondary package with the filled primary packages. Furthermore, this closed secondary package is cut above the top seal. Once the top seal is cooled down, the closed and finished secondary package is released from the outer clamps. This packing system described above preferably uses a sufficiently tight film wrapping for making a bundle of primary packages without deforming the primary packages. Indeed, the filled primary packages are not under substantial tension within the secondary package according to the present invention compared to a stretch film, for example. Nonetheless, the primary packages are sufficiently tightly bundled such that the primary packages are prevented from substantial movement inside the secondary package.

Preferably, the bottom seal (3) and/or the top seal (4) are interrupted seals and not continuous seals. Usually, the overlapping vertical edges (2) along the bottom seal and the top seal are completely sealed to the bottom and top seal. However, this does not allow the exit of a filled primary package located in an extremity of the secondary package near the bottom or top seal. Indeed, only around the middle of the secondary package, the opening of the overlapping vertical edges is wide enough to allow filled primary packages to exit the secondary package. A filled primary package being in an extremity can only exit the secondary package, if the filled primary packages located in the middle portion of the secondary package are first extracted from the inside of the secondary package. Consequently, only when the filled primary packages located in an extremity can be brought to about the middle portion of the secondary package, can these filled primary packages extracted out from the secondary package.

On the contrary, it has been found that if the overlapping vertical edges (2) are not sealed at all or only partially sealed to the bottom and/or top seal of the secondary package at least at the region (2*a*) of overlap of the vertical edges along the bottom and/or top seal, all the filled primary packages can be extracted out from the secondary package in an easier manner and often without the whole procedure as described before. Indeed, the non-sealed or partially sealed part of the overlapping vertical edges allows a sufficient widening of the opening between the vertical edges also near the bottom and/or top seal. Consequently, a filled primary package at the extremity of a secondary package can be directly extracted out from the secondary package in an easier manner and often without emptying first the secondary package.

To achieve that the overlapping vertical edges (2) are not sealed or only partially sealed to the bottom (3) and/or the top seal (4), the cross seal comprises an interruption in the sealing area corresponding to the whole or part of the overlapping vertical edges. This interruption in the sealing area avoids that the overlapping vertical edges are completely sealed together with the bottom and/or the top seal of the secondary package. The partial seal of the overlapping vertical edges to the bottom and/or top seal further prevents that the overlapping vertical edges are loose and flap around. Indeed, loose or flapping overlapping vertical edges may of hindrance for the handling of the secondary package.

Packing the primary packages according to the present invention as described before further allows to reduce the costs of the packaging necessary for handling, storing and transportation of the filled primary packages. Furthermore, the packing of the primary packages into the secondary packages according to the present invention is relatively easy manner which also reduces the manufacturing costs.

Preferably, the closed and finished secondary package falls onto a feed section which brings the closed secondary package containing the filled pouches to a location where the secondary packages can be stacked one over another to form a pallet. It has been found that the granular or powdered detergent according to the present invention contained in the pouches and stacked one over another within the secondary package as described before does not substantially cake such that the detergent is not sticked or aggregated into one insoluble block. Preferably, tie sheets are placed between the stacked shipping units. The tie sheets increase the friction between the stacked shipping units. Consequently, the tie sheets substantially impede any slipping of the shipping units when stacked one over another increasing the stability of the pallet.

Another possibility to substantially impede any slipping of the shipping units when stacked one over another is to apply a glue or an adhesive to part of the outermost surface of the secondary package or to make the secondary package out of an embossed film. The glue or adhesive can be sprayed onto at least part of the outermost surface of the secondary package. The embossed film is preferably made of anti-slip dimples embossed at least on certain areas of the film of the secondary package before the film is carried to the forming shoulder of the VFFS machine. For a further improved stability of the pallet the embossed film can be combined with the tie sheets described before. Additionally, the whole pallet may be further stabilized, especially for transportation, with a stretch film, for example, wrapped around the pallet.

The pallet made as described before allows to eliminate any further outer cases which carry the compression force from the stacked assembly. This results in a substantial cost saving in the total amount of packaging material used for making pallets suitable for storage and transportation. Furthermore, waste is also substantially reduced. Indeed, the outer cases are usually not re-used, but simply disposed. It has been found that the pallet according to the present invention can reduce the waste by at least 50%, preferably at least 80% when compared to pallets using corrugated cardboard as outer cases.

EXAMPLE

The following granular laundry detergent composition was prepared:

| | % by weight |
|---|---|
| Anionic surfactant agglomerate* | 30 |
| Layered silicate compacted granule (supplied by Hoechst under trade name SKS-6) | 18 |
| Percarbonate** | 25 |
| TAED agglomerate | 9 |
| Suds suppressor agglomerate | 2 |
| Perfume encapsulate | 0.2 |
| Granular dense soda ash | 8.4 |
| Granular acrylic-maleic copolymer | 3.2 |
| Enzymes | 3.6 |
| Granular soil release polymer | 0.6 |
| | 100 |

*Anionic surfactant agglomerates were made from a 78% active surfactant paste which comprises C45AS/C35AE3S (alkyl sulfate/alkyl ethoxy sulfate) in the ratio of 80:20. The paste was agglomerates with a powder mixture according to the process described in EPA 510 746. The resulting anionic surfactant granule had a composition of 30% C45AS, 7.5% C35AE3S, 24% zeolite, 20% carbonate, 2.5% CMC, 12% acrylic-maleic co-polymer, and the balance of moisture.

**Percarbonate coated with 2.5% carbonate/sulphate with mean particle size of 500 microns.

The mixture of granular ingredients listed above was placed inside a 140 liter rotating drum that operates at 25 rpm. While operating the drum a mixture of nonionic surfactant (C25E3) and a 20% aqueous solution of optical brightener at ratios of 14:1 were sprayed onto the granular mixture to a level of 7% by weight of the granular components. The spraying time was about 1-2 minutes. Immediately afterwards, perfume was sprayed on, at a level of 0.5% by weight of the granular components, while rotating the drum. Then, without stopping the rotation of the drum, a flow aid was slowly added to the mixer, taking about 30 seconds. The type of flow aid used in the example was partially hydrated zeolite A (6% moisture) and the level of addition was 8%. Once the addition of flow aid was finished, the mixer was allowed to rotate for about 1 minute and was then stopped. The finished product was then removed from the rotating drum. The finished product had a cake strength of less than 50 g/cm$^2$, at about 20 g/cm$^2$.

This finished product was filled into a flexible pouch and the flexible pouches were grouped together in a shipping unit within a secondary package according to the present invention. These shipping unit were than stacked in an assembly forming a pallet. It has been found that the pallet was sufficiently stable during storing and transportation. Furthermore, it has been found that the detergent composition inside the flexible pouches did not substantially cake. This was true wherever the detergent composition was located in the stacked assembly. It has been found that even the detergent composition located in the lowest position of the stacked assembly, where the whole weight of the rest of the pallet is carried, does not substantially cake.

What is claimed is:

1. A shipping unit comprising more than one flexible pouch and a secondary package, each flexible pouch being filled with a granular laundry detergent, the secondary package containing the filled pouches of the shipping unit and keeping the filled pouches together in the shipping unit, the secondary package being closed so that it prevents the exit of any of the filled pouches prior to opening of the shipping unit, wherein the secondary package is flexible and non-resistant to compression force when the shipping unit is stacked with other shipping units in an assembly, and the granular laundry detergent contained in each flexible pouch has a cake strength of less than or equal to 200 g/cm$^2$.

2. A shipping unit according to claim 1 wherein the granular laundry detergent contained in each flexible pouch has a cake strength of less than 100 g/cm$^2$ and the density of the granular laundry detergent is higher than 600 g/l.

3. A shipping unit according to claim 1 wherein each flexible pouch of the shipping unit is substantially free of head space when the pouch is filled and sealed.

4. A shipping unit according to claim 1 wherein the filled pouches which enter into one secondary package are first bundled together.

5. A shipping unit according to claim 1 wherein the secondary package is made of a film wrapping applied so that the filled pouches are not under substantial tension within the secondary package such that the filled pouches are not substantially deformed by the secondary package.

6. A shipping unit according to claim 1 wherein the shipping unit weights up to 50 kg.

7. A shipping unit according to claim 1 wherein the secondary package is made of an embossed film to increase the friction between the secondary packages.

8. An assembly of shipping units or a pallet unit in which the shipping units are stacked one over another and the shipping unit is according to claim 1.

9. An assembly according to claim 8 wherein tie sheets are placed in the assembly between the stacked shipping units.

10. An assembly according to claim 8 wherein the assembly is wrapped around with a stretch film.

* * * * *